United States Patent [19]

Goldstein

[11] Patent Number: 4,800,788

[45] Date of Patent: Jan. 31, 1989

[54] NON-SLIP SCREWDRIVER

[75] Inventor: Howard Goldstein, Staten Island, N.Y.

[73] Assignee: Innovative Computer Tools, Inc., Staten Island, N.Y.

[21] Appl. No.: 111,110

[22] Filed: Oct. 22, 1987

Related U.S. Application Data

[63] Continuation of Ser. No. 848,808, Apr. 4, 1987, abandoned.

[51] Int. Cl.[4] ..... B25B 23/08

[52] U.S. Cl. ..... 81/451

[58] Field of Search ..... 81/451, 461, 439, 452, 81/457

[56] References Cited

U.S. PATENT DOCUMENTS

| | | | |
|---|---|---|---|
| 1,426,320 | 8/1922 | Reid | 81/452 |
| 1,782,565 | 11/1930 | Dohnal | 81/452 |
| 2,954,809 | 10/1960 | Loewy | 81/452 |
| 3,245,446 | 4/1966 | Morifuji | 81/452 |
| 3,517,714 | 6/1970 | Desbarats | 81/451 |

FOREIGN PATENT DOCUMENTS

| | | | |
|---|---|---|---|
| 550190 | 10/1956 | Italy | 81/452 |

*Primary Examiner*—James G. Smith

*Attorney, Agent, or Firm*—Ostrolenk, Faber, Gerb & Soffen

[57] ABSTRACT

A non-slip screwdriver head mechanism is taught. Briefly stated, an inner ferrule is spring biased, in telescoping fashion, inside an outer ferrule. The outer ferrule is held onto the screwdriver shaft through the use of a compressible bushing. The inner ferrule extends beyond the outer ferrule and the screwdriver blade and has a cup-type bore at its free end. By placing the cup end over a screw head, the non-slip screwdriver captures the screw head. The blade is then urged into engagement with the slot on the screw head.

4 Claims, 1 Drawing Sheet

10
11
12
14
16
18
20
22
24
26
27
28
30
32
33
36
38
40
42
44
46
48
50
52

NON-SLIP SCREWDRIVER

This is a continuation of application Ser. No. 848,808 filed on Apr. 4, 1987, now abandoned.

BACKGROUND OF THE INVENTION

This invention relates, generally, to a screwdriver structure and more particularly to a screwdriver structure for capturing the head of a screw.

The use and design of screwdriver type holding structures is relatively well known in the art. These devices are used to perform various functions. One such function is to engage and hold a screw or bolt until it may be properly aligned and screwed into a threaded slot. Other types of devices use a holding structure for rapid screw tightening such as through the use of power tools and the like. Other types of screw holders are used to adjust the depth of the screw or bolt.

One such device may be found in U.S. Pat. No. 3,298,410, "Screw Holder Structure for Use with Screwdrivers", issued Jan. 17, 1967 to Morifuji. This structure is used to hold a screw in place during insertion or removal of the screw. Another type of device may be found in U.S. Pat. No. 3,181,580, "Collet Type Finders for Use With Power Screw Drivers", issued May 4, 1965 to Taylor. This structure uses a screwdriver head which retains the screw securely and releases the screw when the driving is completed. Additionally, this structure is usable with power tools.

U.S. Pat. No. 2,430,044, "Screwdriver and the Like", issued Nov. 4, 1947 to Campsmith, discloses a screwdriver finder type structure which is constructed so that it will cease turning when the screw reaches a desired depth. Further, the structure is readily connectable to a power tool such as a drill or the like.

U.S. Pat. No. 1,708,766, "Screwdriver", issued Apr. 9, 1929 to Lochner, provides a screwdriver structure which helps to locate the groove in the head of the screw.

However, all of these patents are disadvantageous in that they are complicated and expensive to manufacture. Further, the use of standard off-the-shelf screwdrivers is impossible with respect to the Campsmith, Lochner and Taylor patents. Therefore, the holding structure is not readily retrofittable but must be particularly adapted to the use at hand. The Morifuji patent in order to be retrofittable, requires that the end piece be plastic so that it may be properly nested inside the outer shell. However, due to its compressibility, the retainer portion is subject to deterioration, damage and may even come off during use.

The need for screw head alignment structures is particularly important today where computer equipment is utilized. It is frequently the case that a computer is installed into office equipment, furniture or the like, where the connectors interconnecting the various pieces of equipment are difficult to reach without removal or movement of a great many pieces of cable or equipment. Further, it is very difficult to remove computer connectors and the like in this "blind" environment.

SUMMARY OF THE INVENTION

Accordingly, it is an object of the present invention to produce a screw head finder or alignment structure which is inexpensive to manufacture.

It is another object of the present invention to produce a structure which is usable with standard types of screwdrivers and which is retrofittable to various screwdrivers.

It is still a further object of the present invention to provide a screw finder which is sturdy and therefore may stand up to heavy usage.

It is yet another object of the present invention to produce a screw head locator for use with a screwdriver or the like, comprising a rigid outer ferrule. A bushing is used adjacent the shaft of the screwdriver and has the outer ferrule mounted thereto. A rigid inner ferrule is slideably telescoped within predetermined limits in the free end of the outer ferrule wherein at least a portion of the inner ferrule surrounds the blade tip of the screwdriver. A spring is used for urging the inner ferrule outwardly of the free end of the outer ferrule so that the inner ferrule may surround the screw head.

Such a device is taught by the present invention.

BRIEF DESCRIPTION OF THE DRAWINGS

Reference may be now had to the drawings, in which.

DETAILED DESCRIPTION OF THE PREFERRED EMBODIMENTS

Figures 1, 2, 3, 4:
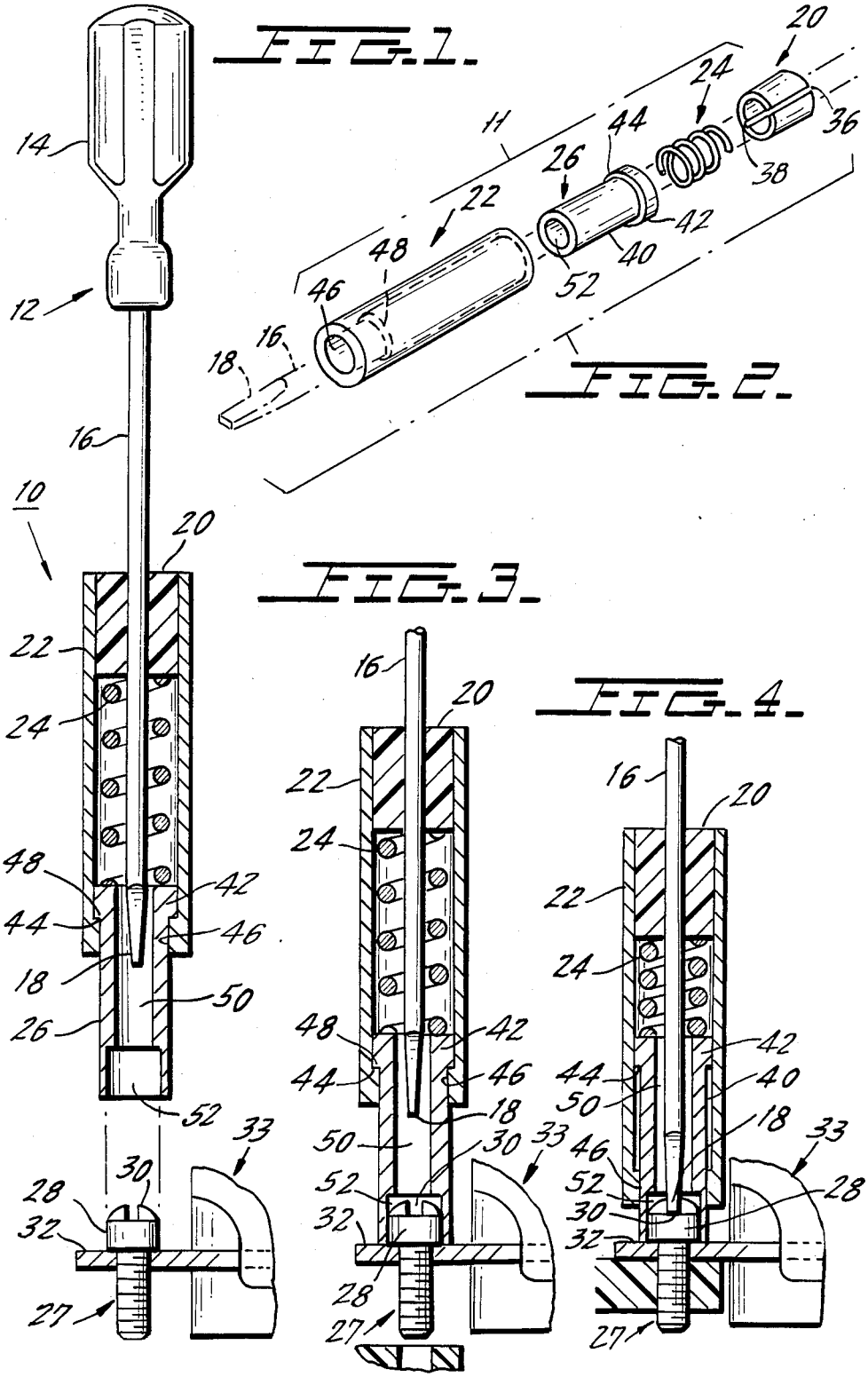
FIG. 1 is an elevational view, partly in cross-section, of the screw head finder structure of the present invention.
FIG. 2 is an exploded view of the assembly of the present invention.
FIG. 3 is a cross-sectional view illustrating capture of a screw head.
FIG. 4 is a cross-sectional view showing engagement of the screw head with a screwdriver blade tip.

As shown in FIGS. 1 and 2, non-slip screwdriver 10 is comprised of a screw head finder assembly shown generally at 11 and a screwdriver 12. The screwdriver 12 consists of a handle 14, a shaft 16 and a blade or blade tip 18. It is to be understood, that although a flat tip screwdriver is shown, other screwdrivers may be utilized such as hexagonal head, cross-recessed or any other suitable configuration. Further, since the screw head finder assembly 11 is retrofittable to screwdriver 12, the relative dimensions of assembly 11 to screwdriver 12 need not be exactly as shown.

Bushing 20 is placed around shaft 16 of screwdriver 12. Bushing 20 is preferably made of a relatively inelastic ABS type plastic. Since bushing 20 is slid over blade tip 18 and onto shaft 16, it is provided with a slit 36 and an indent 38. This thereby allows bushing 20 to expand slightly via slit 36 as well as accommodate blade tip 18 in the indent 38. Further, bushing 20 is preferably tapered as is shown, in slightly exaggerated form, in FIG. 2. This, therefore, allows for an improved force fit when seated in outer ferrule 22. Bushing 20 is placed onto screwdriver shaft 16 before any other components of assembly 11. The remaining components of assembly 11 are either directly in contact with or depend from the position and engagement of bushing 20 on shaft 16 (described more fully below).

Inner ferrule 26 resides inside outer ferrule 22. A Spring 24 is disposed inside outer ferrule 22 between bushing 20 and inner ferrule 26. Spring 24 biases inner ferrule 26 axially outward along screwdriver shaft 16. Due to the force fit nature of bushing 20, bushing 20 when placed into the bore of outer ferrule 22 is compressed onto shaft 16 as well as rigidly engaging the bore of outer ferrule 22. Therefore, outer ferrule 22 is maintained in fixed position onto shaft 16.

Inner ferrule 26 is allowed to axially move along shaft 16 and thereby compresses spring 24. Outer ferrule 22 has a ledge 48 at the distal end which is formed from the reduced diameter of the outer ferrule bore 46. Bore 46 is dimensioned so as to allow shell portion 40 of inner ferrule 26 to slide therethrough. Inner ferrule 26 has at one end a collar 42 which forms a ridge 44. Ridge 44 engages ledge 48 and thereby cooperate with each other so as to capture inner ferrule 26. Collar 42 is in contact with spring 24 and slides along the inside bore of outer ferrule 22. Inner ferrule 26 has an inner ferrule bore 50 through the length of inner ferrule 26 and at the distal end has a screw head capture area or a cup-type end 52. The diameter of cup end 52 is preferably contoured so as to be just slightly larger than screw head 28 with which it is to be used. It is also preferred that ferrules milled from brushed aluminum cylindrical stock although plastic or other types of materials may be utilized.

As an example, a connector is shown generally at 32 and is comprised of a connector housing 33 and a screw 27. Since subminiature D type connectors are predominantly used with computer equipment, all connectors and therefore screws and screw heads are of the same dimension and type. Therefore, the present invention may be used with all standardized computer equipment. The cup end 52, is made to surround screw head 28 so that blade 18 may engage slot 30 in screw head 28 without slipping off. Therefore, the non-slip screwdriver 10 may be used in blind spots thereby obviating the need to move equipment.

To assemble screw head finder assembly 11 and place it onto screwdriver 12, bushing 20 is first placed onto shaft 16 in the manner previously described. Inner ferrule 26 is placed into outer ferrule 22 while spring 24 is placed into outer ferrule 22 and against collar 42 of inner ferrule 26. Ferrules 22, 26 and spring 24 are dimensioned so that the smallest effective inner diameter is slightly larger than the width of blade 18. The mentioned assembled components are then slid over blade 18 and a portion of shaft 16 and then force fitted with bushing 20. Bushing 20 is preferably positioned so that blade 18 extends just beyond the end of outer ferrule 22.

During operation, as shown in FIGS. 3 and 4, non-slip screwdriver 10 is placed adjacent screw head 28. Screwdriver 12 is then urged toward screw head 28 which causes inner ferrule 26 to compress spring 24 and allow blade 18 to engage screw head 28. Thereafter, simply by turning handle 14, blade 18 must invariably align with and engage slot 30 so that screw 27 may be loosened, tightened or adjusted, as appropriate. By allowing blade 18 to move back and forth, it assured that blade 18 will engage slot 30, regardless of the height of screw head 28 with respect to the height of cup end 52.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A screw head locator for use with a screwdriver having a blade tip and a shaft, comprising:

a rigid outer ferrule;

a compressible bushing being tapered so as to form a force fit for fixedly engaging said shaft of said screwdriver and said outer ferrule for positioning the outer ferrule axially on the shaft of the screwdriver; said outer ferrule being spaced from said shaft by said bushing; said bushing being removably positionable on said screwdriver shaft;

said rigid outer ferrule being mountable on and removable from said bushing and being retained thereon by friction;

said bushing being manually adjustable along the length of said screwdriver shaft;

a rigid inner ferrule slideably telescoped, within predetermined limits, in the free end of said outer ferrule, wherein at least a portion of said inner ferrule surrounds the blade tip of said screwdriver; and spring biasing means disposed in said outer ferrule for urging said rigid inner ferrule outwardly of the free end of said outer ferrule so that said inner ferrule may surround said screwdriver head.

2. A screw head locator for use with a screwdriver or the like according to claim 1, wherein said bushing has a slit and an opposing indent so as to allow said blade tip to pass therethrough.

3. A screw head locator for use with a screwdriver according to claim 1, further comprising a collar disposed on the end of said inner ferrule adjacent said free end of said outer ferrule and a ledge formed adjacent the free end of said outer ferrule wherein said collar and said ledge capture at least a portion of said inner ferrule in said outer ferrule.

4. The screw head locator of claim 1, wherein the bushing is provided with a slit extending substantially parallel to the axis of said shaft.

* * * * *